US007254868B2

(12) United States Patent
Mullet et al.

(10) Patent No.: US 7,254,868 B2
(45) Date of Patent: Aug. 14, 2007

(54) WINDING AND ANTI-DROP ASSEMBLY FOR DOOR COUNTERBALANCE SYSTEM

(75) Inventors: Willis J. Mullet, Gulf Breeze, FL (US); Gregory M. Rusnak, Milton, FL (US); John Foreman, Pensacola, FL (US)

(73) Assignee: Wayne-Dalton Corp., Mt. Hope, OH (US)

( * ) Notice: Subject to any disclaimer, the term of this patent is extended or adjusted under 35 U.S.C. 154(b) by 173 days.

(21) Appl. No.: 11/023,203

(22) Filed: Dec. 27, 2004

(65) Prior Publication Data

US 2006/0137138 A1 Jun. 29, 2006

(51) Int. Cl.
*E05F 1/00* (2006.01)

(52) U.S. Cl. ..... 16/198; 160/191

(58) Field of Classification Search ..... 16/197, 16/198, DIG. 1, 400; 160/191, 192, 291, 160/301, 302, 303, 304.1, 318; 49/197, 198, 49/199, 200, 322, 445, 449; 74/322, 333, 74/321, 340, 342, 362, 411.5
See application file for complete search history.

(56) References Cited

U.S. PATENT DOCUMENTS

| | | | | |
|---|---|---|---|---|
| 575,572 | A | | 1/1897 | Parsons |
| 842,936 | A | | 2/1907 | Case |
| 1,194,142 | A | | 8/1916 | Claus |
| 1,936,269 | A | | 11/1933 | Schaffert et al. |
| 2,012,336 | A | | 8/1935 | Blodgett |
| 2,020,831 | A | * | 11/1935 | Greegor ..... 16/198 |
| 2,064,470 | A | | 12/1936 | Heckman |
| 2,097,242 | A | | 10/1937 | Robinson |
| 2,099,191 | A | | 11/1937 | Blodgett |
| 2,185,828 | A | | 1/1940 | Blodgett |
| 2,294,360 | A | | 9/1942 | Blodgett |
| 3,412,780 | A | | 11/1968 | Moler |
| 3,685,567 | A | * | 8/1972 | Pemberton et al. ..... 160/8 |
| 3,699,453 | A | * | 10/1972 | Berenbaum et al. ..... 455/232.1 |
| 3,734,161 | A | | 5/1973 | Pierce ..... 160/133 |
| 3,865,329 | A | * | 2/1975 | Higbee et al. ..... 242/383.1 |
| 3,979,977 | A | | 9/1976 | Dorma ..... 81/57.13 |
| 4,253,350 | A | | 3/1981 | De Tarr ..... 81/3 R |
| 4,282,720 | A | * | 8/1981 | Stottmann et al. ..... 62/180 |
| 4,356,668 | A | | 11/1982 | Wagner ..... 49/506 |
| 4,385,471 | A | | 5/1983 | Gabry ..... 49/322 |
| 4,472,910 | A | | 9/1984 | Iha ..... 49/139 |
| 4,520,591 | A | | 6/1985 | Calvagno ..... 49/322 |
| 4,570,873 | A | | 2/1986 | Kurtti ..... 242/107.4 A |
| 4,583,706 | A | | 4/1986 | Whitehouse ..... 248/251 |
| 4,597,224 | A | | 7/1986 | Tucker ..... 49/199 |
| 4,604,828 | A | | 8/1986 | Baarse ..... 49/322 |
| 4,693,453 | A | | 9/1987 | Ivan ..... 254/323 |

(Continued)

FOREIGN PATENT DOCUMENTS

| | | |
|---|---|---|
| CH | 340 337 | 8/1959 |

(Continued)

*Primary Examiner*—Chuck Y. Mah
(74) *Attorney, Agent, or Firm*—Renner Kenner Greive Bobak Taylor & Weber

(57) ABSTRACT

A counterbalance system (25) for a door (D) movable between a closed position and an open position having an axle (20), a cable drum (15) attached to the axle, a winding shaft (35) interconnected with the axle by a counterbalance spring (26), and a pawl (70) selectively movable between a first position for adjusting tension in the counterbalance spring and a second position for preventing rotation of the cable drum upon failure of the counterbalance spring, thereby limiting movement of the door toward the closed position.

24 Claims, 7 Drawing Sheets

U.S. PATENT DOCUMENTS

| | | | | | |
|---|---|---|---|---|---|
| 4,697,676 | A | * | 10/1987 | Haake | 192/223.2 |
| 4,704,914 | A | * | 11/1987 | Horng | 74/411.5 |
| 4,817,927 | A | | 4/1989 | Martin | 267/155 |
| 4,914,862 | A | | 4/1990 | Gregory | 49/322 |
| 4,930,182 | A | | 6/1990 | Eichenberger | 16/198 |
| 4,940,193 | A | | 7/1990 | Grabowski | 242/107.3 |
| 4,956,938 | A | | 9/1990 | DeMent | 49/28 |
| 4,981,165 | A | | 1/1991 | Miller | 160/191 |
| 5,046,544 | A | | 9/1991 | Coluccio | 160/201 |
| 5,222,327 | A | | 6/1993 | Fellows | 49/139 |
| 5,239,777 | A | | 8/1993 | Husselton | 49/200 |
| 5,253,693 | A | | 10/1993 | Marlatt | 160/7 |
| 5,291,686 | A | | 3/1994 | Sears | 49/322 |
| 5,419,010 | A | | 5/1995 | Mullet | 16/198 |
| 5,482,103 | A | * | 1/1996 | Burgess et al. | 160/9 |
| 5,494,093 | A | | 2/1996 | Eiterman | 160/300 |
| 5,605,079 | A | | 2/1997 | Way | 81/61 |
| 5,615,723 | A | | 4/1997 | Carper | 160/191 |
| 5,632,063 | A | | 5/1997 | Carper | 16/198 |
| 5,636,678 | A | | 6/1997 | Carper | 160/191 |
| 5,698,073 | A | | 12/1997 | Vincenzi | 160/188 |
| 5,706,552 | A | * | 1/1998 | Hsieh | 16/82 |
| 5,743,046 | A | | 4/1998 | Siegler | 49/199 |
| 5,778,490 | A | | 7/1998 | Curtis | 16/198 |
| 5,865,235 | A | | 2/1999 | Krupke et al. | 160/191 |
| 5,911,797 | A | | 6/1999 | Trevorrow et al. | 81/176.1 |
| 5,964,268 | A | | 10/1999 | Carper | 160/191 |
| 5,971,055 | A | | 10/1999 | Rohaut | 160/300 |
| 6,024,155 | A | | 2/2000 | Sharp | 160/201 |
| 6,042,158 | A | | 3/2000 | Horn | 292/165 |
| 6,070,641 | A | * | 6/2000 | Budetti | 160/302 |
| 6,125,582 | A | | 10/2000 | Mondragon et al. | 49/200 |
| 6,134,835 | A | | 10/2000 | Krupke et al. | 49/200 |
| 6,155,327 | A | | 12/2000 | Wells | 160/310 |
| 6,189,266 | B1 | | 2/2001 | Mihalcheon | 49/322 |
| 6,253,824 | B1 | | 7/2001 | Mullet | 160/188 |
| 6,279,268 | B1 | | 8/2001 | Beaudoin et al. | 49/322 |
| 6,283,193 | B1 | | 9/2001 | Finch | 160/191 |
| 6,401,792 | B1 | | 6/2002 | Mullet | 160/188 |
| 6,527,037 | B2 | | 3/2003 | Daus | 160/315 |
| 6,655,088 | B1 | * | 12/2003 | Hormann | 49/200 |
| 6,715,236 | B2 | | 4/2004 | Mullet | 49/322 |
| 6,732,842 | B2 | * | 5/2004 | Nemoto | 192/43.1 |
| 6,862,845 | B2 | | 3/2005 | Schiks | 49/322 |
| 2003/0201077 | A1 | | 10/2003 | Mullet | 160/192 |
| 2003/0221801 | A1 | * | 12/2003 | Beaudoin et al. | 160/191 |
| 2003/0230389 | A1 | * | 12/2003 | Savard et al. | 160/133 |

FOREIGN PATENT DOCUMENTS

| | | | | |
|---|---|---|---|---|
| DE | 3413236 | | 10/1985 | |
| DE | 37 10237 | A1 | 6/1988 | |
| DE | 0172351 | | 10/1988 | |
| DE | 4003218 | A1 * | 8/1991 | |
| DE | G 93 10 792.7 | | 3/1994 | |
| DE | 0678641 | | 8/1999 | |
| EP | 0 151 427 | A | 8/1985 | |
| EP | 0 275 509 | A2 | 12/1987 | |
| EP | 0 392 290 | A1 | 3/1990 | |
| EP | 1 010 851 | A2 | 6/2000 | |
| EP | 1 030 028 | B1 | 4/2004 | |
| FR | 71.04356 | | 9/1972 | |
| FR | 2697570 | | 5/1994 | 49/322 |
| FR | 2715965 | | 8/1995 | |
| WO | WO 03/078773 | A1 | 9/2003 | |

* cited by examiner

WINDING AND ANTI-DROP ASSEMBLY FOR DOOR COUNTERBALANCE SYSTEM

TECHNICAL FIELD

In general, the present invention relates to a counterbalance system for movable barriers such as sectional doors. More particularly, the present invention relates to a counterbalance system for a sectional door having an anti-drop mechanism that prevents uncontrolled closure of the door in the event of failure of the spring in the counterbalance system. More specifically, the present invention relates to a counterbalance system for a sectional door having a combined winding and anti-drop assembly for winding the counterbalance spring and preventing uncontrolled closure of the door in the event of spring failure.

BACKGROUND ART

Most sectional doors employ a track system that guides the door panels from a closed generally vertical position to an open generally horizontal position. Sectional doors normally employ a counterbalance system having a spring to counteract the weight of the door. Optimally, the counterbalance spring would have sufficient tension, such that the door would fully close and only a small amount of force would be necessary to raise the door from the closed position. Counterbalancing springs can be either extension springs or torsion springs. Torsion spring counterbalance systems normally have an axle to distribute the torsional force from the counterbalance spring or springs equally to the door through cable storage drums and cables attached thereto. The counterbalance springs can either be enclosed within the axle or placed outside an axle. The counterbalance springs are pre-tensioned during installation.

Safety considerations dictate the need for a device that prevents the door from falling in the event of eventual failure of one of the components of the counterbalance system, for example, the rupture of the counterbalance spring. Failure of the counterbalance spring while the door is partially open can result in the unexpected and uncontrolled closure of the door. This may cause inconvenience to the user, as well as present safety concerns to anyone located underneath the door at the moment of spring failure. Consequently anti-drop assemblies have been developed that, upon failure of the counterbalance assembly, stop or at least slow descent of the door.

One type of anti-drop mechanism senses loss of tension in the counterbalance cable. The counterbalance cable attaches to the cable drum which, using force of the counterbalance spring and a driving force, raises the door to the upright position. If during operation the cable breaks, the cable in turn loses tension. An example of this type of anti-drop mechanism has a pawl that engages the cable during normal operation, and upon loss in tension, a bias member overcomes any remaining cable tension and pushes the pawl into contact with a stop surface to stop descent of the door. This mechanism is effective against cable breaks but does not protect against counterbalance spring failure.

In another type of anti-drop system, centrifugal force is used to brake the door upon counterbalance spring failure. Typically such systems include a stator, a rotor and a stop dog held in place by bias elements. If the counterbalance spring breaks, the door drops at speeds that are faster than normal operation. As the rotor spins, the centrifugal force overcomes the bias force and moves the stop dog into contact with the stator, thereby stopping the rotor. The reaction speed of these systems is slower than other safety systems, allowing the door to fall further and thereby increase the chance of damage or injury. Further, stronger components are normally needed for such systems, increasing the cost and complexity of the door control components.

Various other anti-drop systems employ arrangements where a counterbalance spring or its axle is attached to a ratchet wheel or a pawl such that upon loss of spring tension the pawl engages the ratchet wheel to lock the mechanism that effects raising and lowering of the door or other barrier. These systems are typically relatively complex in terms of the number and design of the component parts. Further, this complexity and the probability of deterioration or corrosion over years in an inoperative status makes operation of the system problematic when the counterbalance spring normally fails. In addition, many of these anti-drop systems are limited by their design to utilization with counterbalance systems wherein the torsion springs are mounted outside the axle.

DISCLOSURE OF THE INVENTION

It is an aspect of the present invention to provide a counterbalance system for a sectional door having an anti-drop assembly which prevents uncontrolled closure of the door in the event of failure of the counterbalance spring. Another object of the present invention is to provide such a counterbalance system having a combined spring winding and anti-drop assembly for winding the counterbalance spring and preventing uncontrolled closure of the door in the event of failure of the counterbalance spring. A further object of the invention is to provide such a counterbalance system wherein utilization of a dual spring counterbalance system permits the door to be opened, but not closed, when one spring breaks, thereby permitting access to remove vehicles from a building prior to replacement of the broken spring.

A further object of the present invention is to provide a counterbalance system for sectional doors which can be employed in conjunction with counterbalance springs which are mounted either inside or outside of an axle. A further object of the invention is to provide such a counterbalance system, wherein a combined counterbalance spring winding and anti-drop mechanism operates in conjunction with a winding end of a counterbalance spring, rather than the stationary end. Yet another object of the invention is to provide a counterbalance system having a winding or anti-drop assembly that requires only minor modification to the counterbalance spring winding device and the cable drum. A further object of the present invention is to provide such a combined winding and anti-drop assembly for a sectional door counterbalance system which requires relatively few additional or modified parts and thus can be implemented at substantially lower cost than other types of anti-drop systems.

In general, the present invention contemplates a counterbalance system for a door movable between a closed position and an open position having, an axle, a cable drum attached to the axle, a winding shaft interconnected with the axle by a counterbalance spring, and a pawl selectively movable between a first position for adjusting tension in the counterbalance spring and a second position for preventing rotation of the cable drum upon failure of the counterbalance spring, thereby limiting movement of the door toward the closed position.

BEST MODE FOR CARRYING OUT THE INVENTION

Figure 1:
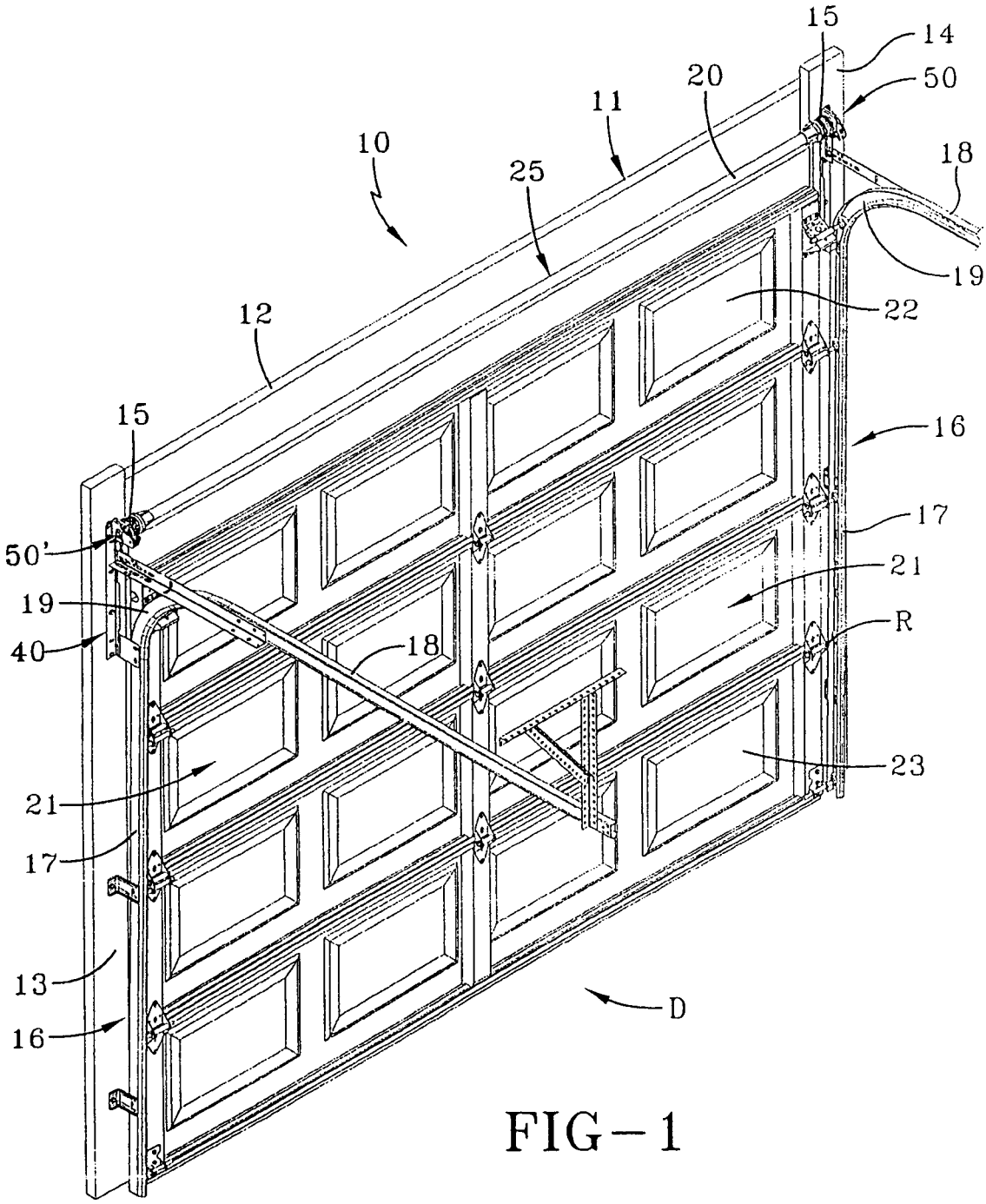
FIG. 1 is a rear perspective view of an exemplary upwardly acting door located within an opening defined in a building and having a counterbalance system operative to provide a balancing force for the weight of the door with a winding and anti-drop assembly according to the concepts of the present invention.

A winding and anti-drop assembly according to the concepts of the present invention is shown in the accompanying figures, and generally indicated by the numeral 50. The winding and anti-drop assembly 50 is used in connection with a barrier such as a door assembly, generally indicated by the numeral 10. Referring particularly to FIG. 1, the door assembly includes a framework 10, generally indicated by the numeral 11, including a header 12 and a pair of vertical jambs 13, 14, mounting guide tracks, generally indicated by the numeral 16, which receive rollers R mounted on an exemplary door D. Framework 11 defines an opening in which the door D is selectively moved from a closed vertical position depicted in FIG. 1 to an open, substantially horizontal position (not shown) where the door D is retracted from the opening.

In general, door D may be an upwardly acting door, such as the sectional door shown by way of example in the drawings. It will be understood that the winding and anti-drop assembly 50 of the present invention may be used with other known doors. The door D may be constructed of a plurality of panels 21 including a top panel 22 and a bottom panel 23. The door D is supported on the guide tracks 16, such that upon opening the door D, the door panels 21 are sequentially transferred from a substantially closed vertical alignment to a substantially open horizontal alignment to store the door D in compact fashion above the opening. To that end, guide tracks 16 to either side of door D each include a vertical track section 17 and a horizontal track section 18 joined by an arcuate transition track section 19.

Figure 2:
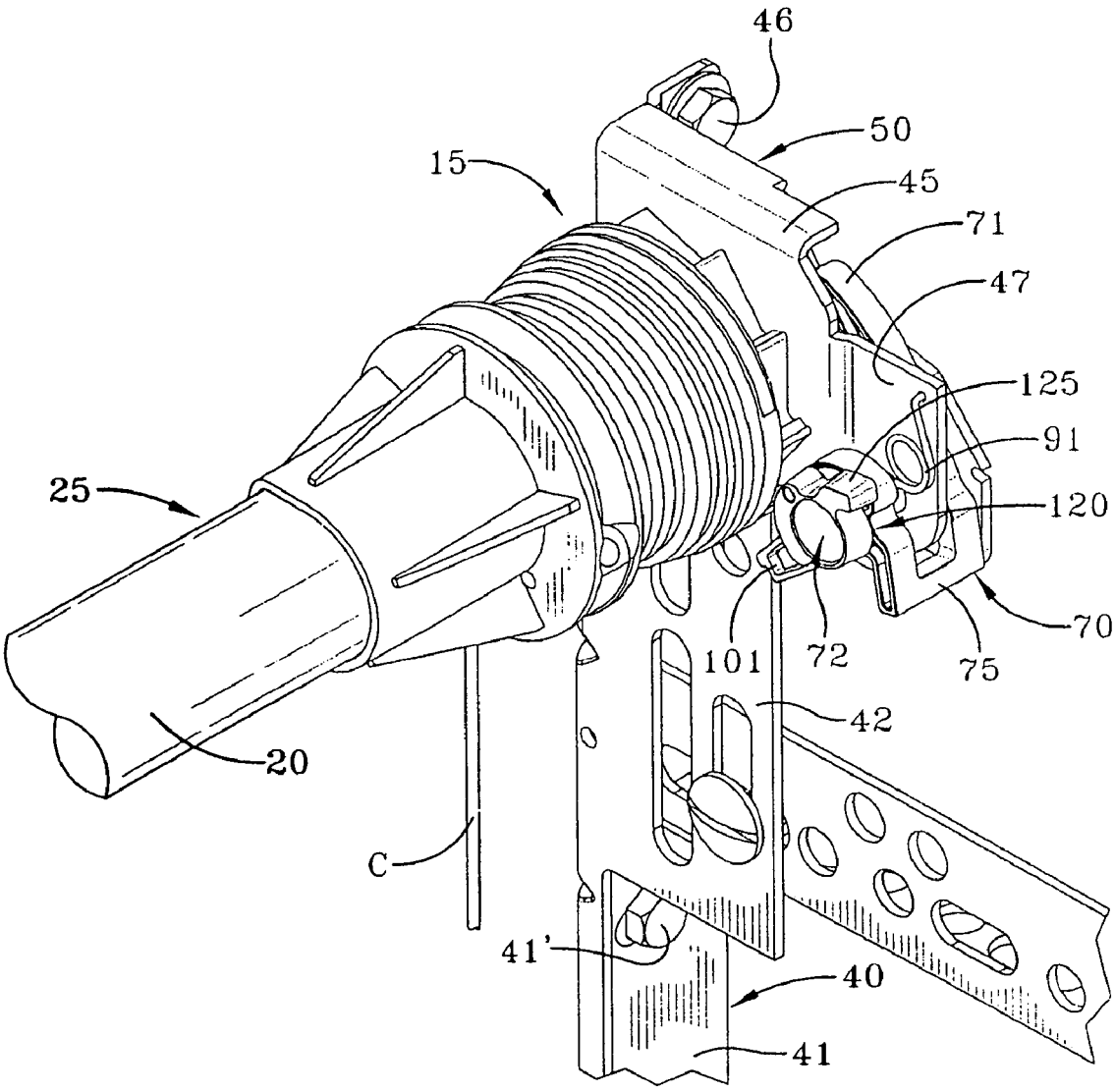
FIG. 2 is an enlarged fragmentary perspective view depicting a support bracket and the winding and anti-drop assembly to the right side of the door as seen in FIG. 1 depicting details of the winding and anti-drop assembly including a first ratchet wheel adjacent to a cable drum, a second ratchet wheel supported on an axle, a pawl pivotally attached to the support bracket and a dual position biasing member located in the normal operating position.
Figure 3:
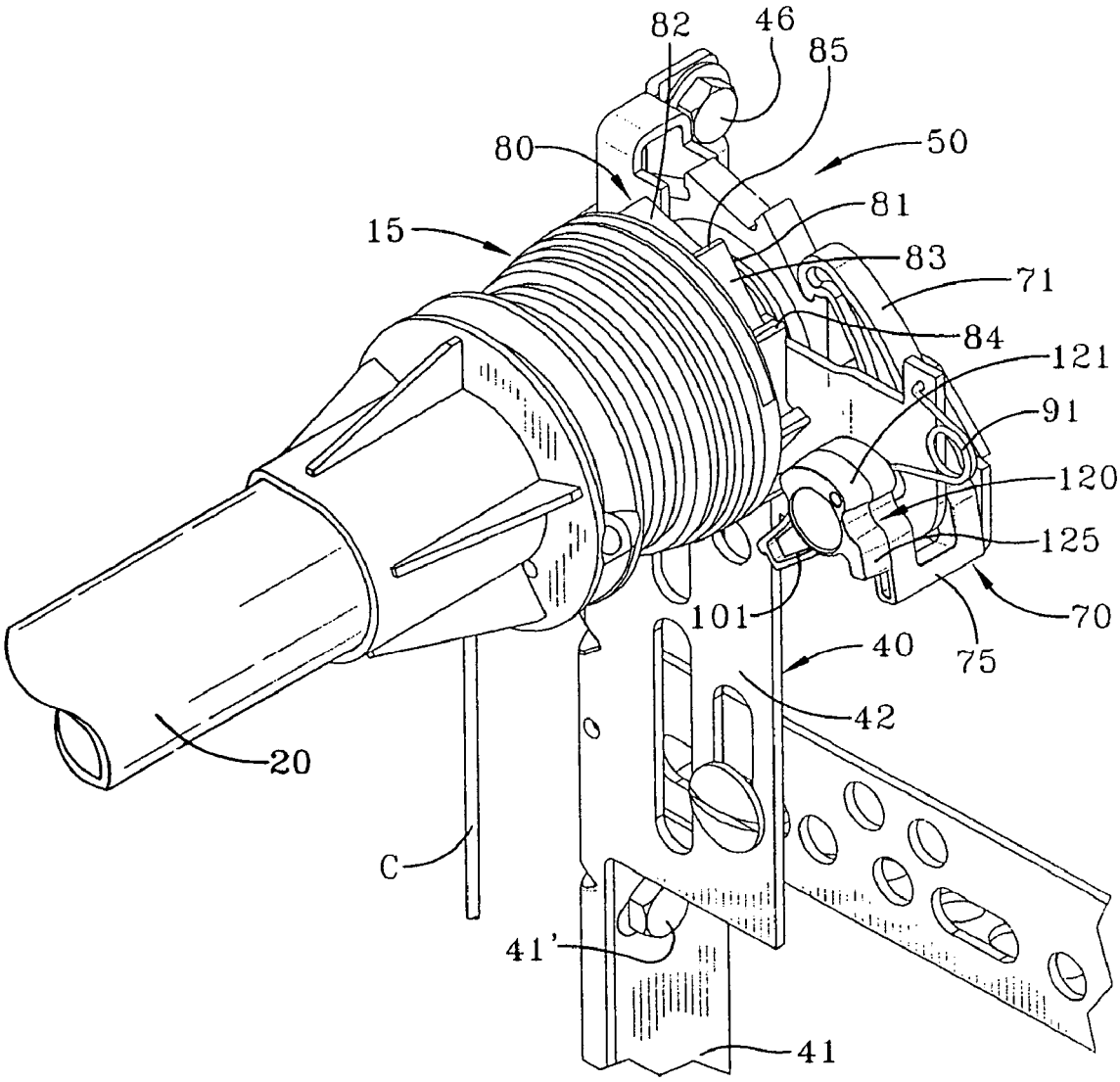
FIG. 3 is an enlarged fragmentary perspective view similar to FIG. 2 depicting the support bracket and the winding and anti-drop assembly on the right side of the door as seen in FIG. 1 with the dual position bias member located in the counterbalance spring winding position.
Figure 4A:
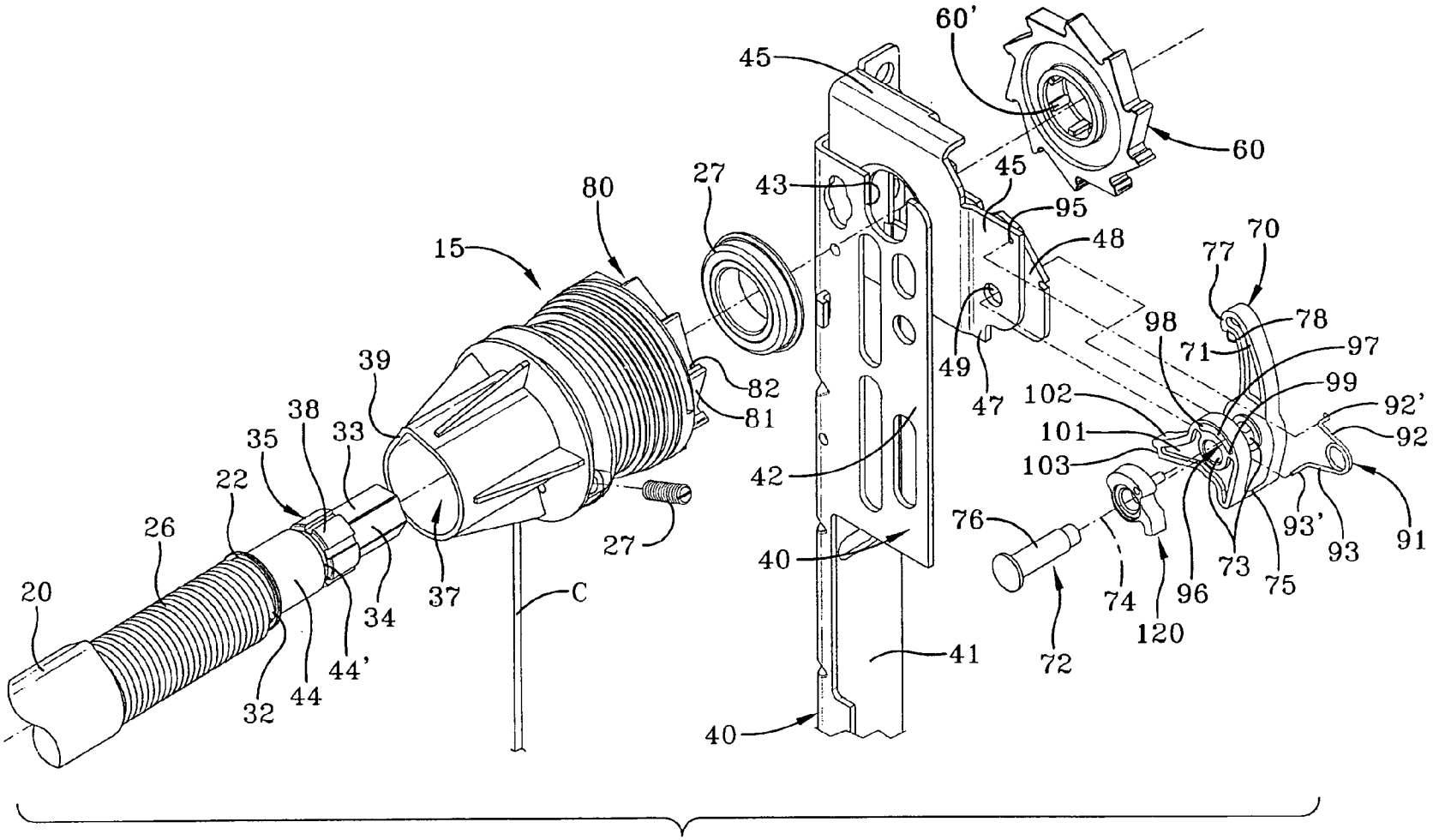
FIG. 4A is an enlarged exploded fragmentary perspective view depicting details of the support bracket and winding and anti-drop assembly on the right side of the door as seen in FIG. 1 looking outwardly and depicting details of the winding and anti-drop assembly and its interrelation with other components of the exemplary counterbalance system.
Figure 4B:
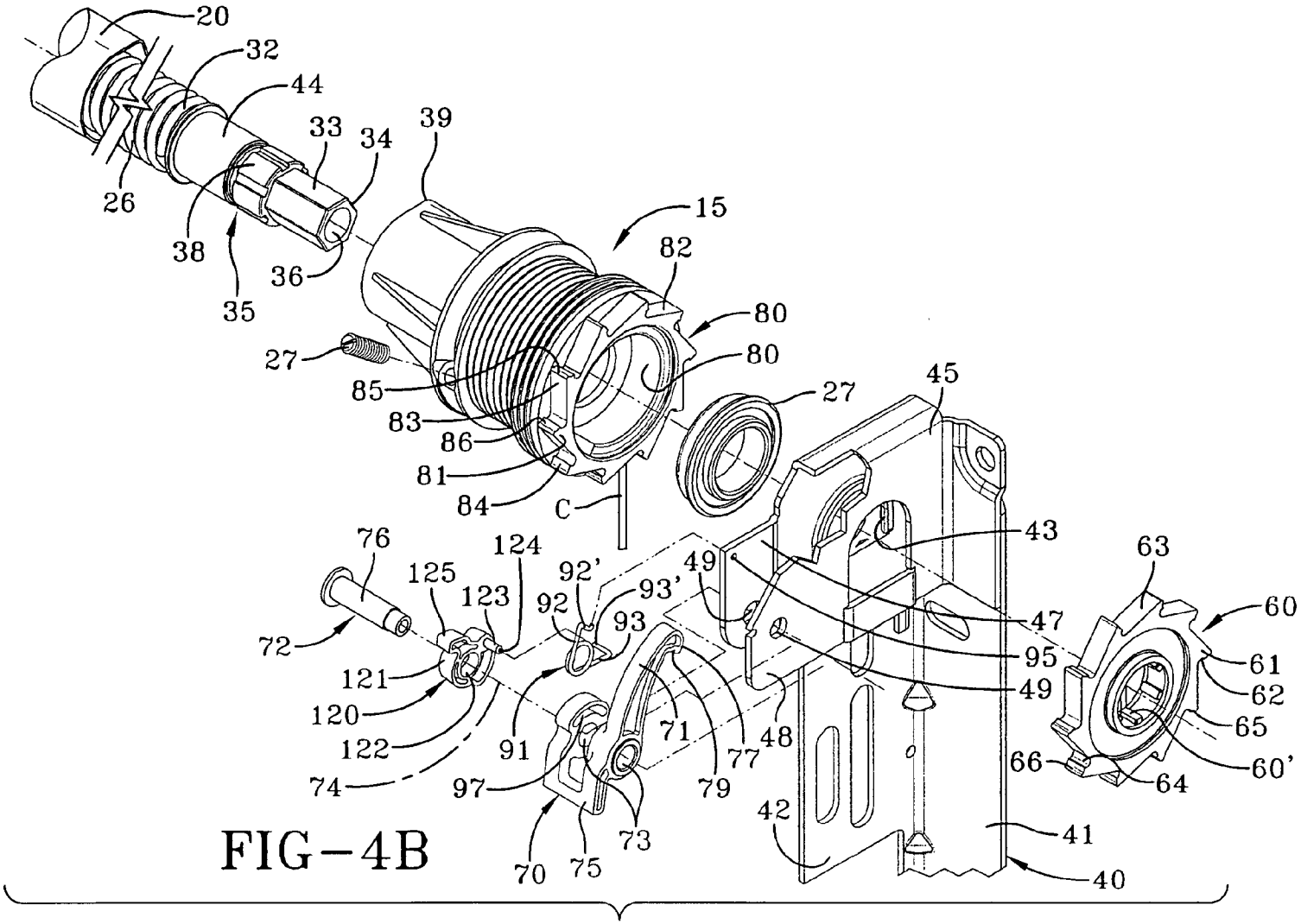
FIG. 4B is an enlarged exploded fragmentary perspective view similar to FIG. 4A depicting details of the support bracket and winding and anti-drop assembly on the right side of the door as seen in FIG. 1 looking inwardly.

To facilitate raising and lowering of the door D, a counterbalance system, generally indicated by the numeral 25, may be employed to offset the weight of the door D. As shown, a counterbalance system 25 has a pair of cable drums, generally indicated by the numeral 15, carried on an axle 20, which may be solid or tubular, receiving a cable C coupled to the bottom of the door D (FIGS. 2 and 3). A set screw 27 attaches cables C to the cable drums 15 (FIG. 4A). Referring to FIGS. 4A and 4B, the counterbalance system 25 may include a counterbalance spring 26 constructed of suitable resilient material, for example, steel, for applying a torsional force to the door D. Counterbalance spring 26 may be a coil spring located generally coaxially with and housed within an axle 20. Alternatively, counterbalance spring 26 may be located externally of axle 20 or coiled around axle 20. Counterbalance spring 26 is attached at one end 32 to a winding shaft, generally indicated by the numeral 35, and at its other end (not shown) to axle 20, directly or by clips or fasteners. In this way, relative rotation of the ends of counterbalance spring 26 may be used to achieve the desired force imposed by counterbalance spring 26. The counterbalance system 25 may be in accordance with Applicant's Assignee's U.S. Pat. No. 5,419,010 and the disclosure therein is incorporated herein by reference.

Referring particularly to FIGS. 3 and 4A and 4B, the axle 20 and winding shaft 35 are supported by spaced flag angles, generally indicated by the numeral 40. Flag angles 40 include a mounting flange 41 suitably attached to the framework 11 or other structure as by cap screws 41' and have an axle supporting portion 42 projecting rearwardly of the frame 11. Axle supporting portion 42 has an opening 43 that receives the winding shaft 35. The opening 43 is sized such that winding shaft 35 is free to rotate therein. A tool end 34 of winding shaft 35 may protrude axially outward of flag angle 40 to receive tools known in the art for selectively rotating winding shaft 35.

Winding shaft 35 may thus be rotated independently of axle 20 to adjust the counterbalancing force generated by counterbalance spring 26. To facilitate the use of ordinary tools to apply tension to the counterbalance spring 26, a tool end 34 of winding shaft 35 may be provided with a faceted outer surface 33 and/or a tool receiving socket 36. For example, surface 33 may have a polygonal cross section, for example, a hexagon, providing a convenient bearing surface for a conventional wrench. Alternatively, or in addition to the faceted outer surface 33, tool end 34 may contain the tool receiving socket 36. The tool receiving socket 36 may be formed on any part of the tool end 34 to provide for the insertion of a tool that provides sufficient leverage to rotate the winding shaft 35.

In the embodiment shown, cable drum 15 is keyed or otherwise nonrotatably coupled to the axle 20, such that the cable drum 15 rotates therewith. For example, as shown in FIG. 4A, cable drum 15 may be coupled by having a noncircular receptacle 39 that corresponds to a noncircular shaped axle 20. This embodiment is shown for example only and it will be appreciated that there are other equally suitable methods of rotationally coupling the cable drum 15 to axle 20. Adjacent to and axially outward from the cable drum 15 is an anti-drop ratchet wheel, generally indicated by the numeral 80. The anti-drop ratchet wheel 80 is coupled to the cable drum 15 such that it rotates therewith. As shown in FIG. 4B, the wheel 80 may be formed integrally with the cable drum 15. Wheel 80 carries a bearing 27 which is supported by a bushing portion 44 of winding shaft 35.

Referring particularly to FIGS. 2, 4A, 4B and 6A, anti-drop ratchet wheel 80 includes a plurality of radially projecting teeth 81 having notches 82 therebetween. Teeth 81 are generally triangular in shape and have a lead surface 83 and an undercut trailing surface 84 on either side of the tip 85 of teeth 81. To further provide a positive stop against movement of an anti-drop pawl arm 101, described more completely below, a detent 86 may be formed in the trailing side 84 of teeth 81. The detent 86 is simply a protrusion formed on the trailing side 84 of tooth 81. The detent 86 is formed such that when an anti-drop pawl arm 101 engages the trailing surface 84 of a tooth 81 any radial forces exerted on pawl arm 101 which would act to move pawl arm 101 out of contact with the first wheel 80 will be absorbed by detent 86.

The winding and anti-drop assembly 50 is provided to adjust and maintain the tension of counterbalance spring 26 as well as provide the safety anti-drop function. It will be appreciated that the winding and anti-drop assembly 50 may be included within a door system 10, or be provided as a separate unit to be used with or retrofit to existing systems. It will be appreciated that some modification of such systems may be needed, in the course of using winding and anti-drop assembly 50 with such systems and such modification is within the scope of the present invention. The incorporation of winding and anti-drop assembly 50 in the described door system 10 is provided only as an example.

As mentioned, winding shaft 35 may protrude axially outwardly of the cable drum 15 through cable drum bore 37 and may be rotationally supported on the bracket 40, as within opening 43 formed in the bracket 40. The winding shaft 35 has axial grooves 38 that engage splines 60' in a winding ratchet wheel 60 for rotation with shaft 35 to wind the spring 26 relative to the axle 20. Referring particularly to FIGS. 4A, 4B and 5, winding ratchet wheel 60 may be outwardly configured substantially like the anti-drop ratchet wheel 80 and includes a plurality of radially projecting teeth 61 having notches 62 therebetween. The teeth 61 are generally triangular in shape and have a lead surface 63 and trailing surface 64 on either side of the tip 65 of teeth 61. The trailing side 64 of tooth 61 may be undercut, as shown.

To provide an audible indication of engagement of the tooth 61 and to further provide a positive stop against movement of a winding pawl arm 71, described more completely below, a detent, generally indicated by the numeral 66, may extend from the trailing side 64 of teeth 61. The detent 66 is simply a protrusion formed on the trailing side 64 of tooth 61 that causes a displacement of the winding pawl arm 71, such that it snaps into place beyond the detent 66 with an audible "click".

Teeth 61 of winding ratchet wheel 60 interrelate with the winding pawl arm 71 to incrementally maintain the rotational position of end 32 of counterbalance spring 26 by way of winding shaft 35. While the ratchet wheel 60 is shown with ten (10) teeth 61, it is to be understood that the number of teeth 61 may be increased or decreased depending on a desired tensioning increment. The tensioning increment, in terms of one revolution of ratchet wheel 60, is essentially inversely proportional to the number of teeth 61. In the embodiment shown, the ten (10) teeth result in a tensioning increment of 1/10 of a revolution.

Referring particularly to FIGS. 4A and 4B, a dual arm pawl, generally indicated by the numeral 70, interacts either with the winding ratchet wheel 60 to hold it against the torsional force of counterbalance spring 26 or with the anti-drop ratchet wheel 80 in the event of failure of counterbalance spring 26, thereby preventing rotation of cable drum 15 coinciding with downward door movement. Pawl 70 includes the anti-drop pawl arm 101 and the winding pawl arm 71 connected by a pawl body 75. Pawl 70 is pivotally mounted on a pawl supporting bracket 45 attached to framework 11 as by a fastener 46 (FIG. 2). Arm 71 and arm 101 may be provided with aligned bores 73 through which a retainer 72 is received creating a pivot axis, generally indicated at 74, for pawl 70.

Figure 5C:
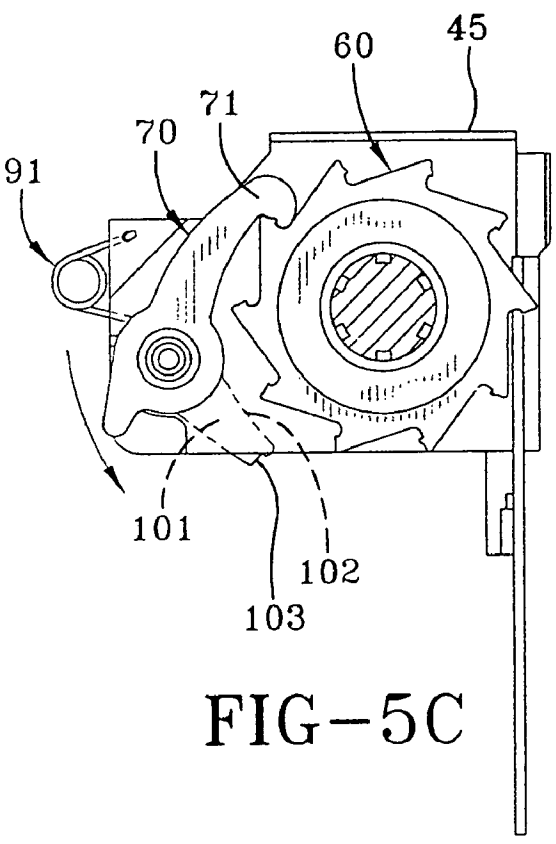
FIG. 5C is an enlarged side elevational view similar to FIGS. 5A and 5B depicting the winding and anti-drop assembly in the activated position after spring winding.

As best seen in FIG. 4A, retainer 72, which may take the form of a rivet, includes a shank 76 which is sized to fit bores 73 formed in pawl 70. When assembled, arm 101 extends outwardly from pivot axis 74 toward the ratchet wheel 80. Arm 71 is angularly offset from the arm 101 and extends outwardly from the pivot axis 74 toward the ratchet wheel 60. The bracket 45 may be a yoke-like configuration having spaced, substantially parallel walls 47 and 48 with aligned bores 49 for receiving and supporting retainer 72 for pawl 70. The walls 47, 48 enclose and ensure mating alignment of the arms 71 and 101 of pawl 70 and ratchet wheels 60 and 80, respectively. Referring to FIGS. 4A, 4B and 5A, arm 71 is a hook-like member having a curved first surface 77 that is engaged by the leading surface 63 of the teeth 61 and a second surface 78 that engages the trailing surface 64 of teeth 61 to hold the ratchet wheel 60 against rotational force imparted by the counterbalance spring 26 when wound. To provide a positive radial lock of the arm 71, upon engagement with trailing surface 64 of teeth 61, the second surface 78 of arm 71 may include a recess 79 adapted to receive the detent 66 of teeth 61.

Pawl 70 is selectively rotationally biased by a spring member, generally indicated by the numeral 91. In the embodiment shown in FIGS. 5 and 6, depending upon its position, the spring member 91 exerts a force on pawl 70 to drive it toward an engaged position by means of opposed first and second legs 92 and 93, respectively. In the example shown, the first leg 92 of spring member 91 is held fixed by an offset 92' (FIG. 4) formed at the end that is secured to an adjacent fixed member such as an aperture 95 located on pawl bracket 45. The second leg 93 of spring member 91 has an angled extension 93' that may be placed in contact with a bias locator 96 to control the direction biasing force is applied to the pawl 70. As will be appreciated from the above description, the biasing force of the spring member 91 may be provided in a variety of configurations and the spring member 91 may take various forms, other than the coil spring configuration shown.

The bias locator 96 is positioned on the pawl 70. In the embodiment shown in FIG. 4A, the bias locator 96 is positioned on the anti-drop pawl arm 101 radially displaced from the bore 74 and includes an arcuate slot 97 having a first slot end 98 and a second slot end 99. The extension 93' of second leg 93 of the spring member 91 is slidably located in the arcuate slot 97 and selectively reposes at either the first slot end 98 or the second slot end 99. When the extension 93' of spring member 91 rests against the first slot end 98 the resulting bias force urges the pawl arm 71 into contact with the ratchet wheel 60. When the extension 93' of spring member 91 rests against the second slot end 99 the resulting bias force urges the pawl arm 71 away from contact with the ratchet wheel 60 and urges the pawl arm 101 into contact with the ratchet wheel 80. In this manner, the winding and anti-drop assembly 50 is capable of two orientations, a winding orientation and an anti-drop orientation depending upon the placement of the spring member 91 within the bias locator 96. The winding orientation also facilitates counterbalance system installation by maintaining the tension on the counterbalance spring 26 in a ratchet fashion during winding of the spring 26.

Figure 5B:
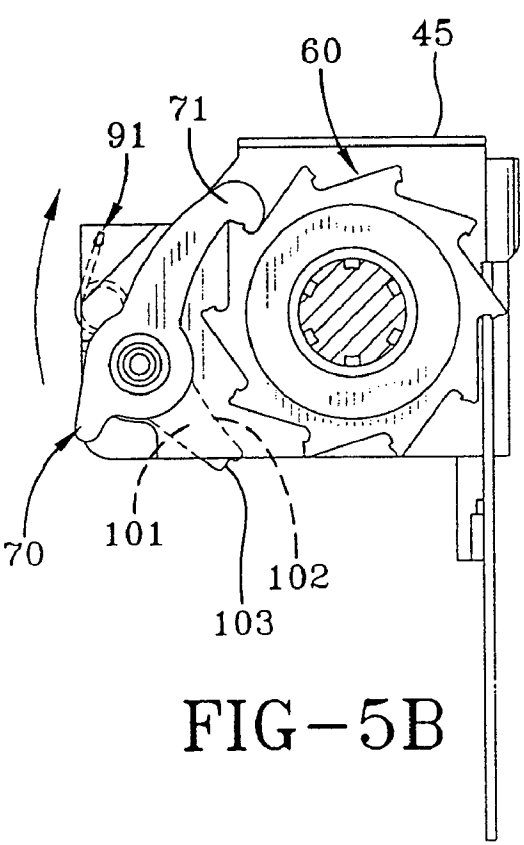
FIG. 5B is an enlarged side elevational view similar to FIG. 5A depicting the winding and anti-drop assembly in the spring winding position.
Figure 5A:
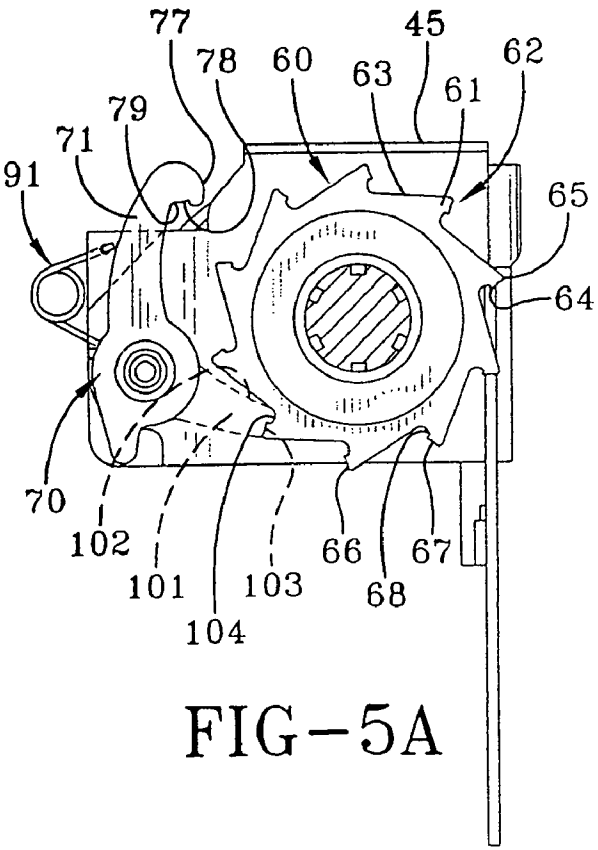
FIG. 5A is an enlarged side elevational view looking axially inward at the right hand side winding and anti-drop assembly of FIG. 1 depicting the winding and anti-drop assembly in the locked anti-drop position after a counterbalance system failure.
Figure 6C:
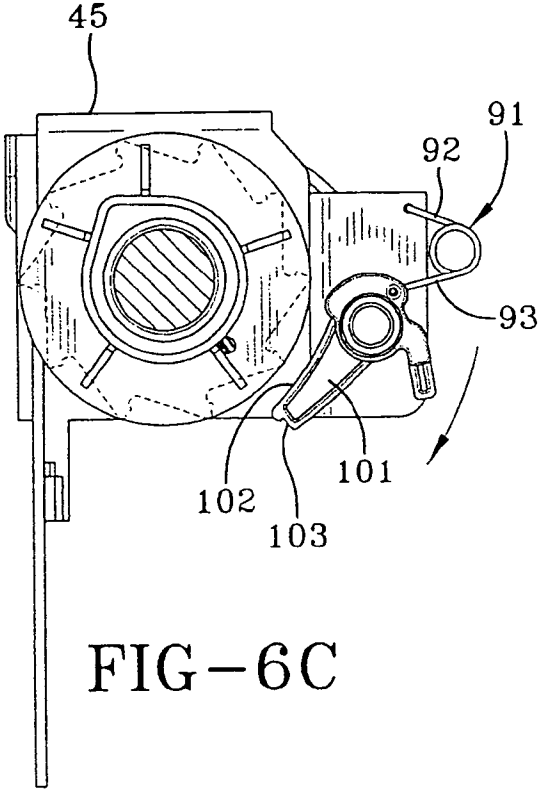
FIG. 6*c* is an enlarged side elevational view similar to FIGS. 6A and 6B depicting the winding and anti-drop assembly in the activated position after spring loading.
Figure 6B:
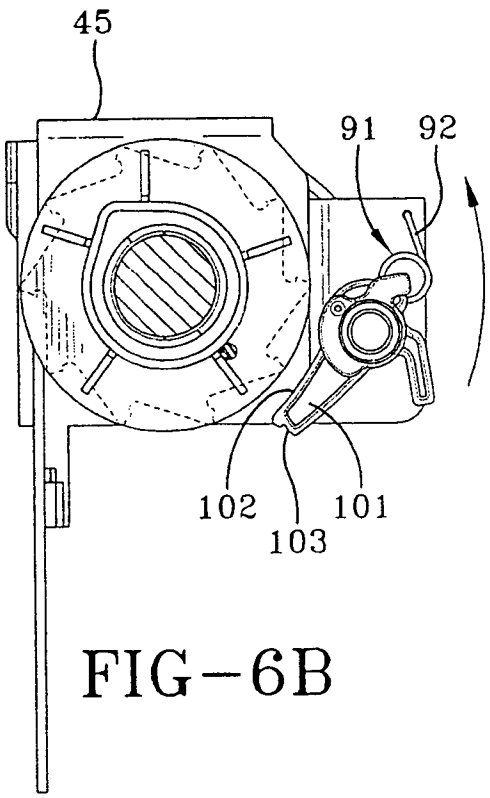
FIG. 6B is an enlarged side elevational view similar to FIG. 6A depicting the winding and anti-drop assembly in the spring winding position.

Referring to FIGS. 3, 5B and 6B, the winding operation of spring 26 is effected when the pawl 70 is biased such that the winding pawl arm 71 is forced against the winding ratchet wheel 60 by spring 91. The extension 93" of spring member 91 is positioned at first slot end 98 of arcuate slot 96. In this manner, when the ratchet wheel 60 is rotated, such that the leading side 63 of the teeth 61 are driven against the surface 77 of arm 71, the teeth 61 and arm 71 act in a cam follower fashion with the slope of the leading surface 63 of teeth 61 driving the arm 71 radially outward relative to the teeth 61 against the bias force of the spring 91. In this fashion, the arm 71 rides along the lead surface 63 of teeth 61 until passing the tip 65 of a tooth 61, at which point the arm 71 rotates inwardly relative to the tooth 61 along the trailing surface 64 of the teeth. As the winding pawl arm 71 drops into the notch 62 between teeth 61, it may produce an audible "click" as its surface 77 contacts the surface 63 of ratchet wheel 60.

The winding and anti-drop assembly 50 automatically retains the position of winding shaft 35 and accordingly tension on counterbalance system 25 by arm 71 maintaining a locking engagement with ratchet wheel 60. In the embodiment shown, to increase spring force in spring 26 of counterbalance system 25, a winding force is applied to winding shaft 35 in a manner described above. Once the force of spring 26 of counterbalance system 25 is overcome, the wheel 60 rotates. Arm 71 of pawl 70 follows the contour of ratchet wheel 60. Once the user stops applying a tensioning force, the force of the counterbalance system 25 would cause the ratchet wheel 60 to rotate in the opposite direction catching the second surface 78 of arm 71 preventing release of tension produced by counterbalance spring 26.

Referring now to FIGS. 2, 5C and 6C, once the desired amount of counterbalance force is achieved, the extension 93' of spring 91 is moved along the arcuate slot 96 until the extension 93' of spring member 91 rests against the second slot end 99 to arm or activate the winding and anti-drop assembly 50 in the anti-drop orientation. This operation biases the pawl 70 in the opposite rotational direction, tending to pull the arm 71 away from the wheel 60. Under tension of the counterbalance spring 26 in normal operating conditions, the arm 71 does not decouple from the wheel 60 because the torsional force created by the counterbalance spring 26 maintains arm 71 in contact with teeth 61 with a greater force than that created by spring member 91 tending to rotate arm 71 out of contact with wheel 61. In this manner the arm 71 holds the wheel 60 against the force of the counterbalance spring 26 indefinitely.

Figure 6A:
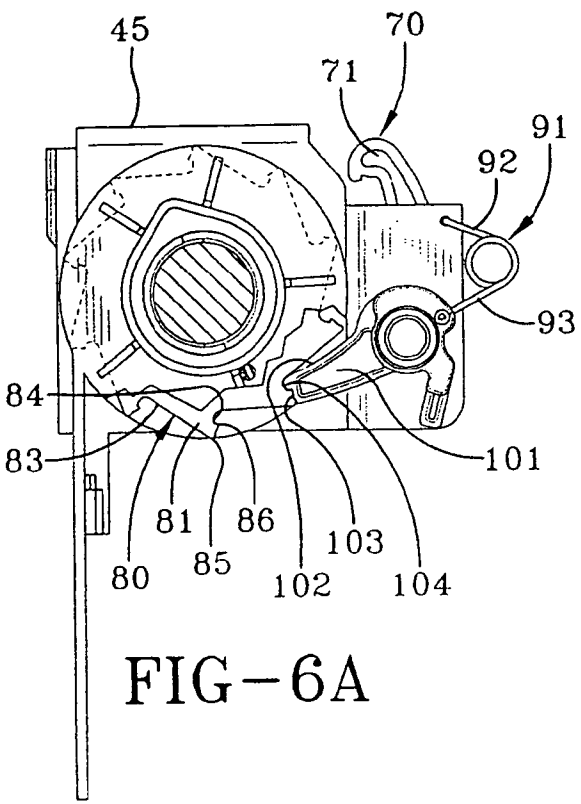
FIG. 6A is an enlarged side elevational view with portions broken away looking axially outward at the right hand side winding and anti-drop assembly seen in FIG. 1 depicting the winding and anti-drop assembly in the locked anti-drop orientation after a counterbalance system failure.

As moving elements, the counterbalance spring 26 particularly and other counterbalance system 25 components are prone to eventual failure. Upon breakage of the counterbalance spring 26, the torsional force created by the counterbalance spring 26 on wheel 60 is released, freeing the pawl 70 to rotate away from wheel 60. Because the pawl is now biased in the opposite direction, the pawl 70 pivots so that arm 101 engages the wheel 80, as seen in FIGS. 5A and 6A.

Arm 101 extends outwardly from the pivot axis 74 toward the wheel 80. Arm 101 has a first surface 102 that is engaged by the leading surface 83 of the teeth 81 and a second surface 103 that engages the trailing side 82 of teeth 81 to hold the second wheel 80 against rotation initiated by weight of the falling door. To provide a greater positive radial lock of the anti-drop pawl arm 101, upon engagement with trailing surface 84 of teeth 81, the second surface 103 of anti-drop pawl arm 101 may include a recess 104 adapted to receive the detent 86 of teeth 81 (FIGS. 4A and 6A). Under the force of the spring member 91, arm 101 contacts the wheel 80 and follows the contour of the wheel 80 until the arm 101 encounters the trailing surface 82 of a tooth 81, at which point the weight of the door D is held relative to the flag angle 40 by arm 101. Because the cable drum 15 rotates with the wheel 80, engagement of the arm 101 with the wheel 80 prevents rotation in the direction corresponding with the downward movement of the door and thus precludes the door D from dropping when the counterbalance spring 26 fails. Depending upon the design of the wheel 80, free drop of the door D can be limited to a minimal distance, such as approximately 1 inch or less. At that point, the door cannot be lowered further but can be raised to effect corrective maintenance.

While the spring 91 may be manually manipulated to move extension 93' along arcuate slot 96 between first slot end 98 and second slot end 99, winding and anti-drop assembly 50 may be provided with an arming mechanism, generally indicated by the numeral 120, to effect this spring positioning function. Referring to FIGS. 2, 3 and 4B, the arming mechanism 120 has a generally cylindrical body 121 with a through bore 122 (FIG. 4B) receiving shank 76 of retainer 72 for rotation thereon. The body 121 has an axially projecting stub shaft 123 which is sized and positioned to move in the arcuate slot 96 in pawl arm 101. The stub shaft 123 has a bore 124 for seating the extension 93' of spring 91 for movement therewith. The body 121 may also have a radially projecting lever arm 125 to facilitate manually gripping the arming mechanism 120 to rotate the stub shaft 123 and extension 93' of spring 91 between the positions depicted in FIGS. 2 and 3 of the drawings.

While the winding and anti-drop assembly 50 described above is located at the right side of the counterbalance system 25 and door D depicted in FIG. 1, it is to be appreciated that a similar winding and anti-drop assembly 50 is advantageously located at the left side of counterbalance system 25 as seen in FIG. 1. The winding and anti-drop assembly 50' may be a mirror image of the winding and anti-drop assembly 50.

Thus, it should be evident that the winding and anti-drop assembly for door counterbalance system disclosed herein carries out one or more of the objects of the present invention set forth above and otherwise constitutes an advantageous contribution to the art. As will be apparent to persons skilled in the art, modifications can be made to the preferred embodiments disclosed herein without departing from the spirit of the invention, the scope of the invention herein being limited solely by the scope of the attached claims.

The invention claimed is:

1. A counterbalance system for a door movable between a closed position and an open position comprising, an axle, a cable drum rotatable with said axle, a winding shaft interconnected with said axle by a counterbalance spring, a first ratchet wheel operatively interconnected to said winding shaft, a second ratchet wheel operatively interconnected to said axle and a pawl selectively movable between a first position, contacting said first ratchet wheel, for adjusting tension in said counterbalance spring and a second position, contacting said second ratchet wheel, for preventing rotation of said cable drum upon failure of said counterbalance spring, thereby limiting movement of the door toward the closed position.

2. A counterbalance system according to claim 1, wherein a biasing member selectively urges said pawl toward said first position and said second position.

3. A counterbalance system according to claim 2, wherein said pawl is pivotally mounted.

4. A counterbalance system according to claim 2, wherein said biasing member is a spring that selectively biases said pawi in one direction in said first position and in the other direction in said second position.

5. A counterbalance system according to claim 4, wherein said spring is a torsion spring having a fixed leg and a movable leg engaging a locator on said pawl.

6. A counterbalance system according to claim 5, wherein said locator is a slot, wherein said movable leg of said torsion is selectively positioned at one end of said slot to urge said pawl toward said first position and at the other end of said slot to urge said pawl toward said second position.

7. A counterbalance system according to claim 6, wherein an arming mechanism transfers said movable leg from one end of said slot to the other end of said slot.

8. A counterbalance system for an upwardly acting door comprising, an axle, a cable drum rotatable with said axle, a winding shaft interconnected with said axle by a counterbalance spring, and a combined winding and anti-drop assembly having a dual arm pawl, said dual arm pawi having a first arm selectively interrelating with a first notched element coupled to said winding shaft to adjust the counterbalance forces on the door and a second arm selectively interrelating with a second notched element coupled to said cable drum to prevent rotation of said cable drum and lowering of the door in the event of failure of said counterbalance spring.

9. A counterbalance system according to claim 8, wherein said first notched element includes a ratchet wheel, said winding shaft mounts said ratchet wheel for rotation therewith, said first arm selectively engaging said ratchet wheel.

10. A counterbalance system according to claim 8, wherein said second notched element includes a ratchet wheel, said cable drum carries said ratchet wheel for rotation therewith, said second arm selectively engaging said ratchet wheel.

11. A counterbalance system according to claim 10, wherein said ratchet wheel is formed integral with said cable drum.

12. A counterbalance system according to claim 11, wherein said axle including a hollow portion, said counterbalance spring being a torsion spring positioned within said hollow portion.

13. A counterbalance system according to claim 8, wherein a biasing member selectively urges rotation of said dual arm pawl in a first direction or an opposed second direction.

14. A counterbalance system according to claim 13, wherein said biasing member is a coil spring.

15. A counterbalance system according to claim 13, wherein said biasing member selectively engages said dual arm pawl at a first or a second arcuately spaced location.

16. A counterbalance system according to claim 15, wherein said spaced locations are defined by the ends of an arcuate slot.

17. A counterbalance system according to claim 16, wherein said biasing member is a torsion spring having a first leg and a second leg, said first leg fixed and said second leg provided with an extension engaging said arcuate slot.

18. A counterbalance system according to claim 17, wherein an arming mechanism moves said extension of said other leg between said ends of said arcuate slot.

19. A counterbalance system according to claim 8, wherein said first notched element includes a first ratchet wheel that is rotatable with said winding shaft, and said second notched element includes a second ratchet wheel rotatable with said cable drum, said first arm selectively engages said first ratchet wheel and said second arm selectively engages said second ratchet wheel.

20. A winding and anti-drop assembly for a counterbalance system having an axle, a cable drum rotatable with the axle, a winding shaft interconnected with the axle by a counterbalance spring, and a cable attached to said cable drum and to an upwardly acting door comprising, a first ratchet wheel adapted to rotate with the winding shaft, a second ratchet wheel adapted to rotate with the cable drum, and a pawl selectively engaging said first ratchet wheel to tension the counterbalance spring and selectively engaging said second ratchet wheel to prevent rotation of the cable drum upon failure of the counterbalance spring, wherein said second ratchet wheel rotates independently of said first ratchet wheel.

21. A winding and anti-drop assembly according to claim 20, wherein said pawl has a first arm for engaging said first ratchet wheel and a second arm for engaging said second ratchet wheel.

22. A winding and anti-drop assembly according to claim 20, wherein a biasing member selectively urges said pawl into engagement with either of said first ratchet wheel and said second ratchet wheel.

23. A winding and anti-drop assembly according to claim 22, wherein said pawl is pivotally mounted to rotate in one direction to engage said first ratchet wheel and in the other direction to engage said second ratchet wheel.

24. A counterbalance system for a door movable between a closed position and an open position comprising, an axle, a cable drum rotatable with said axle, a winding shaft interconnected with said axle by a counterbalance spring, a first ratchet wheel connected to said winding shaft, a second ratchet wheel connected to said axle and a pawl movable between a first position, contacting said first ratchet wheel, and a second position, contacting said second ratchet wheel, a spring having a fixed leg and a movable leg engaging a locator on said pawl, said locator being a slot, wherein said movable leg of said spring is selectively positioned at one end of said slot to urge said pawl toward said first position and at the other end of said slot to urge said pawl toward said second position.

* * * * *